US008375860B2

(12) United States Patent
Bittle et al.

(10) Patent No.: US 8,375,860 B2
(45) Date of Patent: Feb. 19, 2013

(54) STACKABLE, EASILY PACKAGED AND AERODYNAMICALLY STABLE FLECHETTE

(75) Inventors: David A. Bittle, Somerville, AL (US); Robert V. Weber, Huntsville, AL (US); Julian L. Cothran, Arab, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 142 days.

(21) Appl. No.: 13/101,018

(22) Filed: May 4, 2011

(65) Prior Publication Data

US 2011/0272518 A1 Nov. 10, 2011

Related U.S. Application Data

(60) Provisional application No. 61/331,666, filed on May 5, 2010.

(51) Int. Cl.
*F42B 10/04* (2006.01)
*F42B 12/02* (2006.01)

(52) U.S. Cl. ..... 102/501; 102/517; 102/703; 244/3.24

(58) Field of Classification Search ..... 102/491, 102/501, 517, 519, 703; 244/3.1, 3.24
See application file for complete search history.

(56) References Cited

U.S. PATENT DOCUMENTS

| | | | | |
|---|---|---|---|---|
| 582,982 | A * | 5/1897 | Cope | 244/3.23 |
| 2,939,395 | A | 6/1960 | Barr | |
| 2,979,285 | A | 4/1961 | Planitizer | |
| 3,033,116 | A * | 5/1962 | Critcher et al. | 102/521 |
| 3,148,472 | A * | 9/1964 | Hegge et al. | 42/106 |
| 3,412,681 | A * | 11/1968 | Schirneker | 102/438 |
| 3,545,383 | A | 12/1970 | Lucy | |
| 3,851,590 | A | 12/1974 | LaCosta | |
| 3,880,083 | A | 4/1975 | Wasserman et al. | |
| 3,915,092 | A * | 10/1975 | Monson et al. | 102/399 |
| 3,941,059 | A | 3/1976 | Cobb | |
| 3,977,324 | A * | 8/1976 | Stevenson et al. | 102/442 |
| 4,043,798 | A * | 8/1977 | Nashiwa et al. | 420/84 |
| 4,448,106 | A * | 5/1984 | Knapp | 89/1.11 |
| 4,471,358 | A * | 9/1984 | Glasser | 342/12 |
| 4,546,940 | A * | 10/1985 | Andersson et al. | 244/3.29 |

(Continued)

FOREIGN PATENT DOCUMENTS

| | | | |
|---|---|---|---|
| DE | 3838737 | A1 * | 5/1990 |
| DE | 3940969 | A1 * | 6/1991 |

OTHER PUBLICATIONS

Howstuff Works, "Basics, Alternative Shotgun Shells", copyright 2005, (picture of flechette shell) http://science.howstuffworks.com/shotgun11.htm.

(Continued)

*Primary Examiner* — Bret Hayes
(74) *Attorney, Agent, or Firm* — Michael K. Gray

(57) ABSTRACT

A flechette has a forward section or body (12) containing its center of gravity. A quill (10) is connected to the forward section and is integrally connected to a pair of fins (15A, 15B) each having a longitudinal angle and a radial angle. When the two fins are viewed from the aft of the flechette, the pair of fins demonstrate an S-shaped orientation. The size, shape and orientation of the fins provide aerodynamic stability to the flechette while allowing the flechette to be stacked with like-shaped flechettes in rows and columns or in a radial, circular arrangement. When stacked in rows and columns or in a circular arrangement, each flechette has its nose oriented in the same forward direction.

9 Claims, 5 Drawing Sheets

U.S. PATENT DOCUMENTS

| | | | | |
|---|---|---|---|---|
| 4,597,333 | A | 7/1986 | Bocker et al. | |
| 4,627,357 | A | 12/1986 | Gobis | |
| 4,638,738 | A | 1/1987 | Bisping et al. | |
| 5,223,667 | A | 6/1993 | Anderson | |
| 5,473,989 | A | 12/1995 | Buc | |
| 5,476,045 | A * | 12/1995 | Chung et al. | 102/529 |
| 5,796,031 | A | 8/1998 | Sigler | |
| 6,779,462 | B2 * | 8/2004 | Lloyd | 102/475 |
| 7,007,608 | B2 | 3/2006 | Flanagan | |
| 7,107,910 | B2 | 9/2006 | Hunn et al. | |
| 7,786,416 | B2 * | 8/2010 | Williams et al. | 244/3.1 |
| 2010/0057285 | A1 * | 3/2010 | Murphy et al. | 701/23 |
| 2011/0272518 | A1 * | 11/2011 | Bittle et al. | 244/3.1 |
| 2012/0279413 | A1 * | 11/2012 | Bittle et al. | 102/517 |

OTHER PUBLICATIONS

Advertisement: "S-Shaped Green Chair" having stackable design, available on internet at least by Apr. 5, 2010, http://www.overstock.com/Home-Garden/S-shaped-Green-Chair-Set-of-2/3063508/product.html.

Advertisement: "Rocket shape promotion ballpoint pen", Available on internet at least by Apr. 5, 2010, http://www.alibaba.com/showroom/rocket-pen.html.

Peak of Flight Newsletter, Issue 220, Oct. 21, 2008, "Can you Design a 2-Fin Rocket?" Cover page and pp. 7-8.

* cited by examiner

STACKABLE, EASILY PACKAGED AND AERODYNAMICALLY STABLE FLECHETTE

BENEFIT CLAIMED

Benefit is claimed to the provisional application of the same title, application No. 61/331,666, filed on May 5, 2010.

DEDICATORY CLAUSE

The invention described herein may be manufactured, used and licensed by or for the U.S. Government for U.S. Government purposes without payment of any royalties thereon.

BACKGROUND OF THE INVENTION

1. Field of the Invention

The present invention pertains to flechettes or dart-like projectiles.

2. Discussion of the Background

Conventional flechettes in the 60 grain to 150 grain weight class have been used successfully in weapons but suffer from two drawbacks. The first drawback is that their flight characteristics are suboptimal. High speed film of their flight shows that most of the flechettes dispensed from a warhead pitch and yaw significantly during their flight. The pitch and yaw behavior, which slows the flechettes and reduces their lethality, is due to a combination of transverse angular rates induced at dispense, aerodynamic or physical interactions between flechettes in the dispensed population and manufacturing imperfections in the flechettes themselves.

As a result of these effects, flechette patterns are typically extremely elongated along the axis tangent to the flight path, with a significant time lag between the arrival at the target of the first flechettes, (which have the highest velocity and are the most lethal), and the last arriving, slower flechettes (which are the least lethal). The elongated patterns indicate that conventional flechettes lose significant portions of their velocity and lethality attempting to recover a nose-first orientation after experiencing high transverse angular rate perturbations.

The second drawback with the conventional flechette design is that packing constraints limit the size of the flechette tailfins to a size smaller than would be ideal to optimize their flight stability. (Flechettes having four tailfins are the conventional design). If the tailfins are made larger for better flight performance, the flechettes do not pack well. If they are made smaller for better packaging, the flechettes lose even more terminal performance due to increased angular rate oscillations.

SUMMARY OF THE INVENTION

The flechette of the present invention has its concentration of mass centered in a forward section or body for stability with a quill body offset by two tailfins. The two tailfins are arranged in a "Z" or S-shaped formation when viewed from the aft end of the flechette.

The flechette body is rectangular with an aspect ratio chosen so that the packing density is maximized, and the tailfins are rotated to an angle relative to the rectangular flechette body so that the tailfins of adjacent flechettes do not interfere with each other. Additionally, the tailfins of the flechette are angled to improve flight characteristics by inducing a spin to the flechette as it flies through the air. The wide separation between the center of gravity of the flechette and its center of pressure ensures that the flechette recovers quickly from any pitch or yaw angle (up to being completely reversed).

Inducing a rolling moment to the flechette allows the perturbations caused by manufacturing imperfections to be integrated out of the flight path while the flechette is in flight. The flechette of the present experiences low drag while achieving uniform and stable flight characteristics. When multiple flechettes of the present invention are stacked into a packaged unit, each flechette of the packaged unit, upon being dispensed, will achieve similar flight characteristics so as to arrive at a target with greater uniformity and accuracy.

DESCRIPTION OF THE DRAWINGS

A more complete appreciation of the invention and many of the attendant advantages thereof will be readily obtained by reference to the following detailed description when considered in connection with the accompanying drawings.

DETAILED DESCRIPTION

Figure 1:
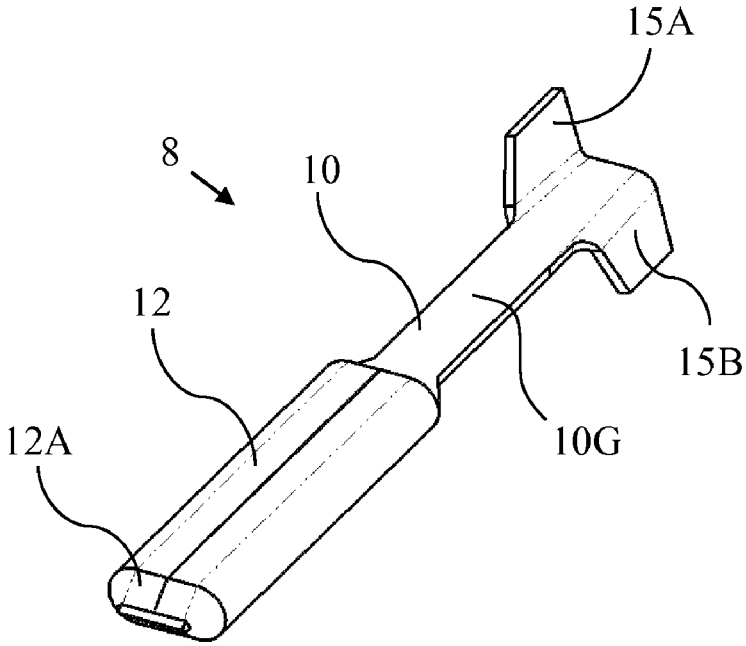
FIG. 1 is a perspective drawing of the flechette of the present invention.

With reference to FIG. 1, the flechette 8 of the present invention has a quill 10 which is connected to a forward section 12 which has a substantially rectangular box-like shape, with the forward section 12 having a front tip or nose 12A. The quill is integrally connected to two tailfins or fins 15A, 15B located in the extreme aft of the flechette 8. Both fins are arranged so as to form a compound angularity which is represented by a longitudinal angle $\theta$ and a radial angle $\Phi$.

Figure 2:
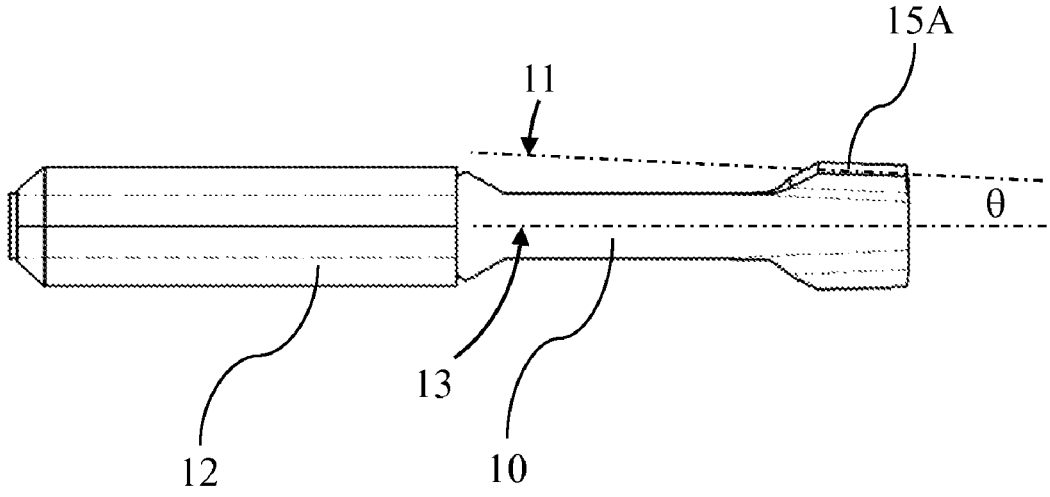
FIG. 2 is a top or bottom view of the flechette of the present invention.
Figure 3:
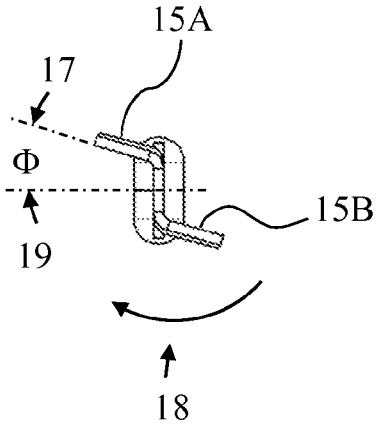
FIG. 3 is an aft view of the two tailfins of the present invention which demonstrates the generally "Z" or S-shaped arrangement of the tailfins.

In FIG. 2, the longitudinal angle $\theta$ is understood as being that angle formed by dotted lines 11 and 13. With reference to FIG. 3, radial angle $\Phi$ is understood as being formed by dotted lines 17 and 19. As FIG. 3 further demonstrates, fins 15A and 15B have a Z-shaped or S-shaped orientation. As is portrayed by arrow 18 of FIG. 3, the shape and angular orientation of fins 15A and 15B cause flechette 8 to spin or rotate in flight.

Figure 4:
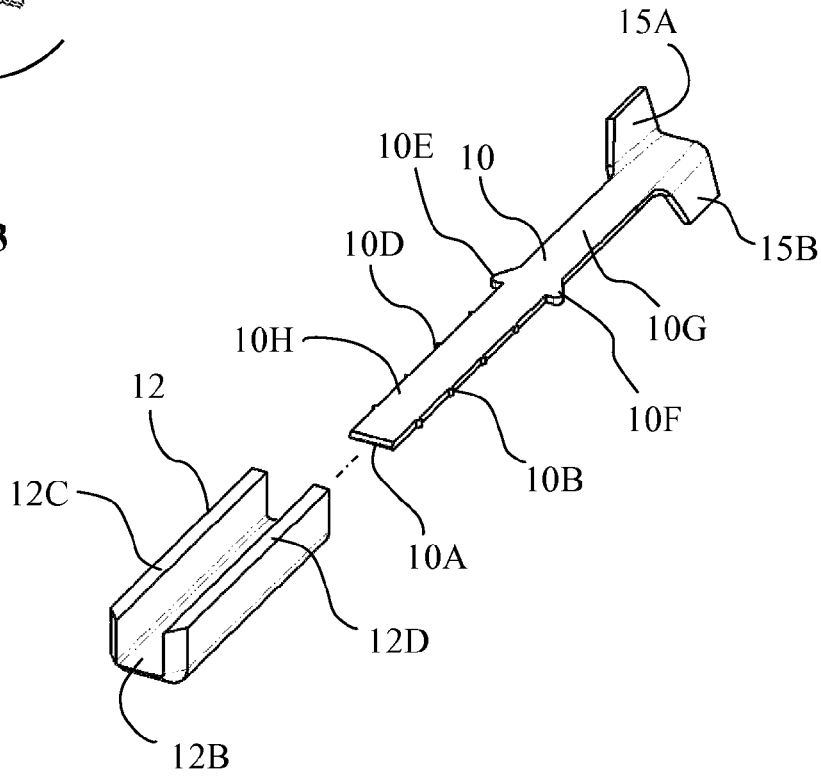
FIG. 4 is an exploded view of the tip and quill of the present invention prior to assembly.

In FIG. 4, a preassembled flechette 8 of the present invention includes the forward section 12 which is made of sheet stock or tubing or other appropriate material. Forward section 12 includes integrally formed sides 12C and 12D which are located above and at the lateral sides of the bottom 12B of forward section 12. Quill 10 includes flanges 10E and 10F and a front tip 10A. Serrated barbs, such as barbs 10B and 10D are positioned at a location between flanges 10E and 10F and the front tip 10A. Barbs 10B and 10D are arranged on the lateral side edges of the quill and perform a securing function by digging into the inner sidewalls of sides 12C and 12D when the quill 10 is inserted into the forward section 12. Exterior section 10G is the region of quill 10 which is not inserted into the forward section 12.

The flanges 10E and 10F prevent further insertion of the quill 10 into the forward section 12. Interior section 10H is the portion of the quill 10 which is inserted inside the front section 12. The length of the forward section 12 and interior section 10H are the same, with interior section 10H extending from the front tip 10A to flanges 10E and 10F.

Figure 5:
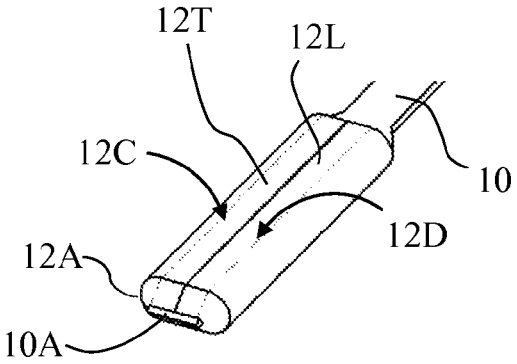
FIG. 5 is frontal perspective view of an assembled flechette of the present invention.

The quill 10 and the forward section 12 are press-fit together and stamped such that sides 12C and 12D meet along line 12L (FIG. 5) to form a top portion 12T of forward section 12. Once press fit together, the interior section 10H of quill 10 forms the center region of front section 12. Once press fit together, the forward section 12 has a relatively flat top and bottom and becomes a rectangular forward body.

Upon the forward section 12 and quill 10 being assembled together, the tip or nose 12A of the forward section 12 is tapered with the front tip 10A of quill 10 being positioned at the front and in the middle of nose 12A. The nose 12A can be machined to give a desired shape, such as a sharp or pointed nose.

Once the flechette 8 of the present invention is manufactured and assembled, the flechette becomes a one-piece aerodynamic body of symmetrical shape. (Thus, the terms top or bottom can be used interchangeably in respect to flechette 8). The quill 10 can be cut from steel or aluminum sheet or strips with a material composition and thickness suitable to common sheet metal for manufacturing and forming processes. The front section 12 can be made from similar or higher density materials to that of the quill 10 and can be formed from metal tubing or metal sheet or strip material.

Figure 6:
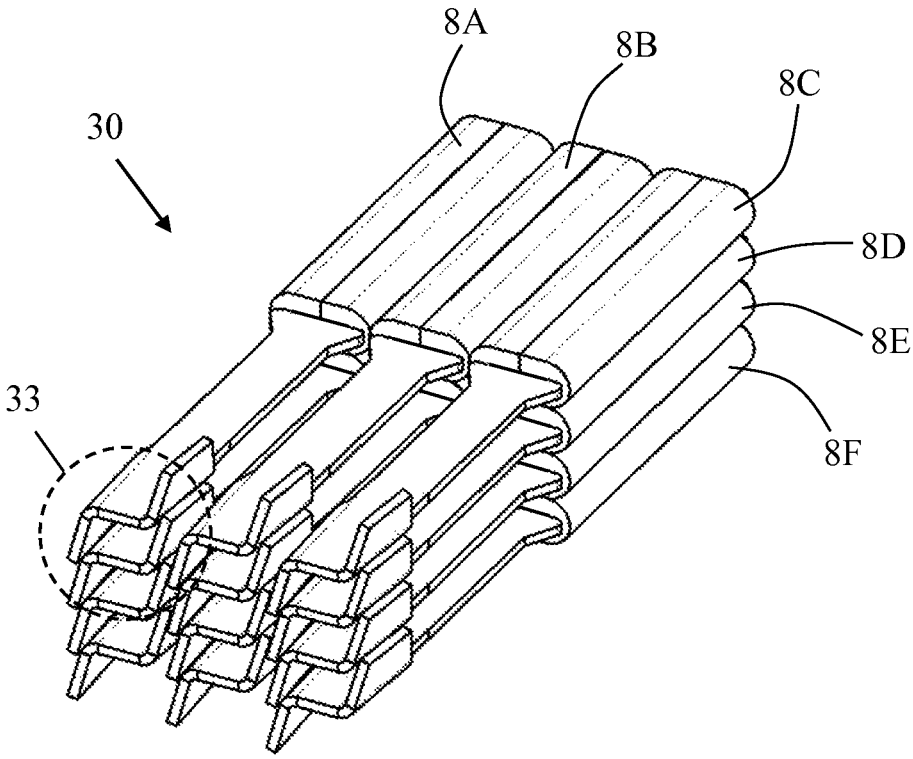
FIG. 6 is a perspective view of packaged flechettes of the present invention which are stacked in row and columns.

With reference to FIG. 6, a stacked rectangular array of flechettes 30 according to the present invention has three columns and four rows of flechettes with flechettes 8A, 8B and 8C forming one row of flechettes and flechettes 8C, 8D, 8E and 8F form one column of flechettes. Dotted circle 33 highlights how the "Z" or S-shaped fins of the flechettes of the present invention allow effective stacking without interference between the flechettes.

Figure 7:
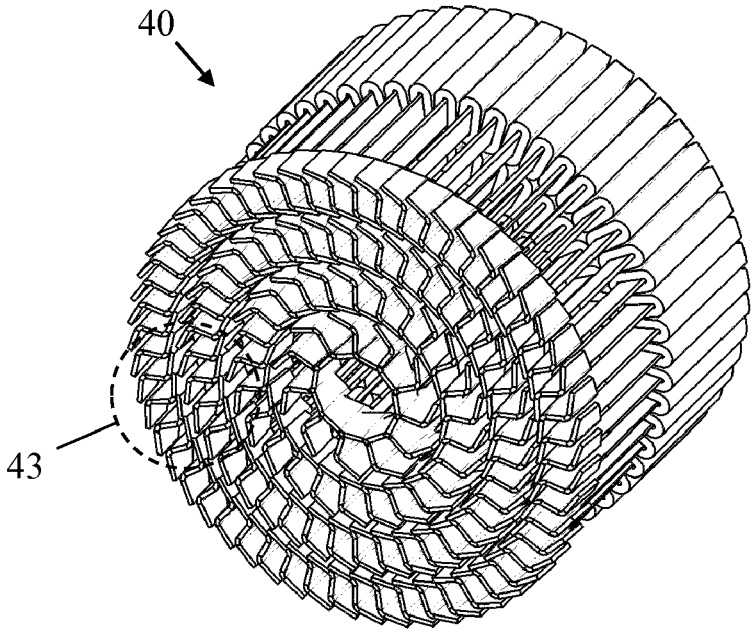
FIG. 7 is a perspective view of packaged flechettes of the present invention which are stacked in a radial arrangement or formation.

In FIG. 7, a radially stacked arrangement or puck 40 of flechettes according to the present invention is shown which demonstrates four radially oriented rows or circles of flechettes. Dotted arc 43 highlights that the S-Shaped fins of the flechette 8 of the present invention allow multiple flechettes of the present invention to be radially packaged without interference between adjacent flechettes within the same radially row and without interference between the flechettes in adjacent radial rows.

Figure 8:
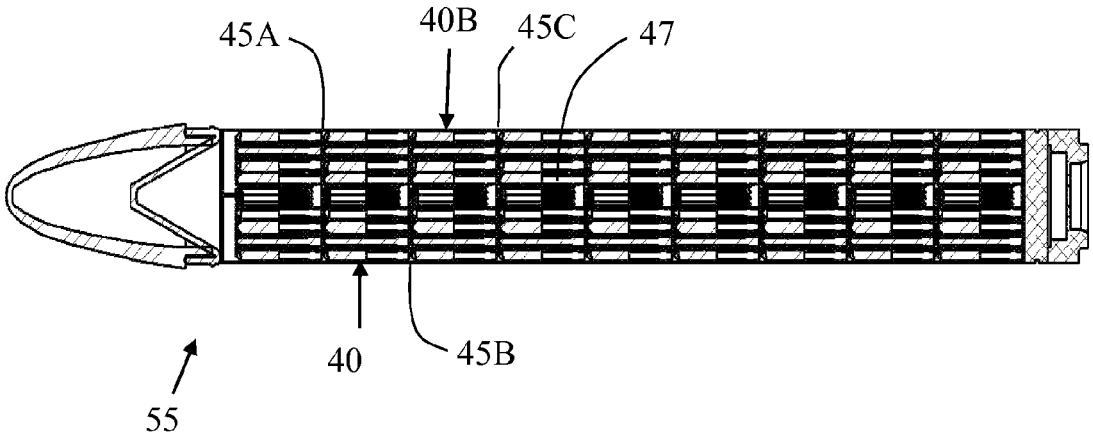
FIG. 8 is a side, sectional view of a warhead having tiers or stages of flechettes of the present invention which are stacked into pucks within each tier.

In FIG. 8, a warhead 55, such as, for example, the warhead of a Hydra 70 rocket, is provided with bulkheads represented by bulkheads 45A, 45B, 45C, etc., which form flechette tiers or compartments. Pucks 40A, 40B, etc., of flechettes according to the present invention are placed within the compartments in the orientation demonstrated in FIG. 7 with a center pole 47 being provided in each flechette tier which acts as the center axis for the radially oriented flechettes.

Figure 9:
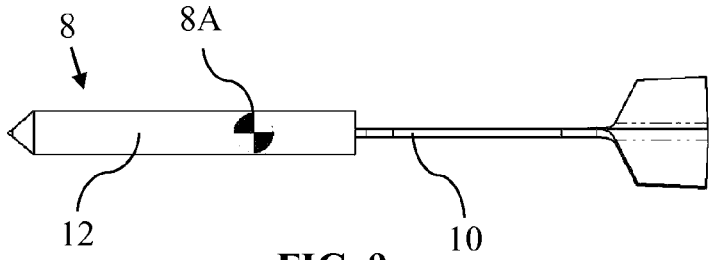
FIG. 9 is a side view of a flechette according to the present invention which illustrates the location of its center of gravity.

In FIG. 9, a side view of the flechette 8 according to the present invention demonstrates that the center of gravity 8A of the flechette is located in the front section 12. FIG. 9 further demonstrates the narrow thickness of the quill 10 of the present invention when compared with its length and width (see FIGS. 1 and 4).

Figure 10:
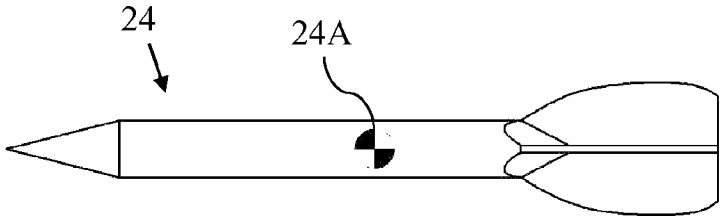
FIG. 10 (Prior Art)
FIG. 10 is a side view of a typical prior art flechette which illustrates the location of its center of gravity.

In FIG. 10, the center of gravity 24A of a conventional, prior art flechette 24 is shown.

Figure 11:
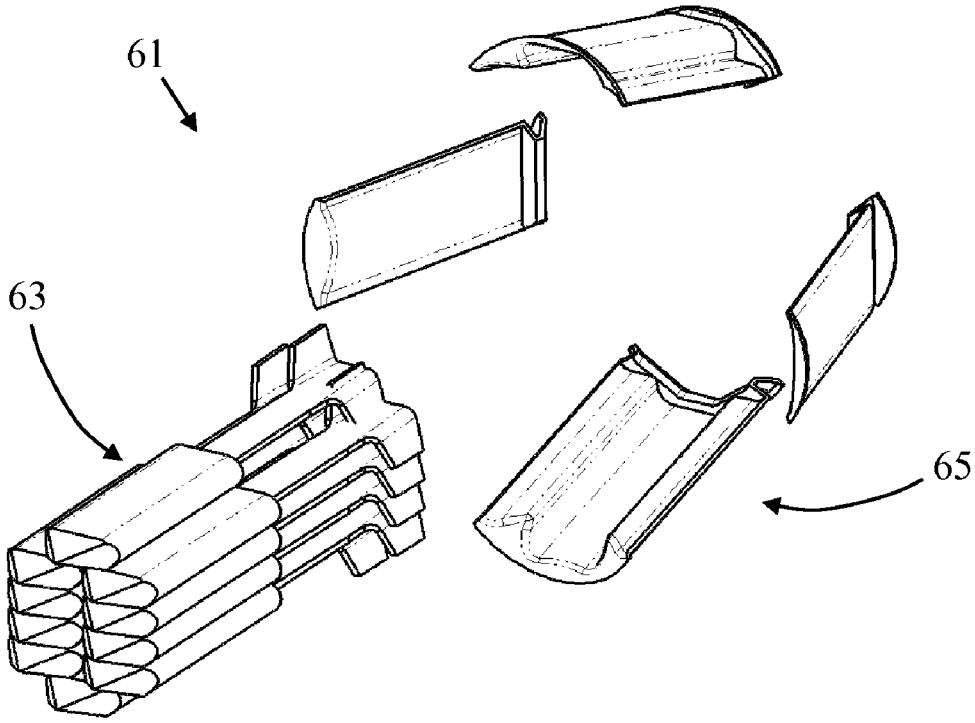
FIG. 11 is a partially exploded view illustrating flechettes of the present invention as they could be arranged within a cylindrical housing.

In FIG. 11, the partially exploded view demonstrates a packaging design 61 for a stacked configuration of flechettes 63 according to the present invention for placement within a cylindrical housing 65. The cylindrical housing has trenched portions at its top and bottom for accommodating flechettes which are positioned on the top and bottom of the stacked configuration 63.

Figure 12:
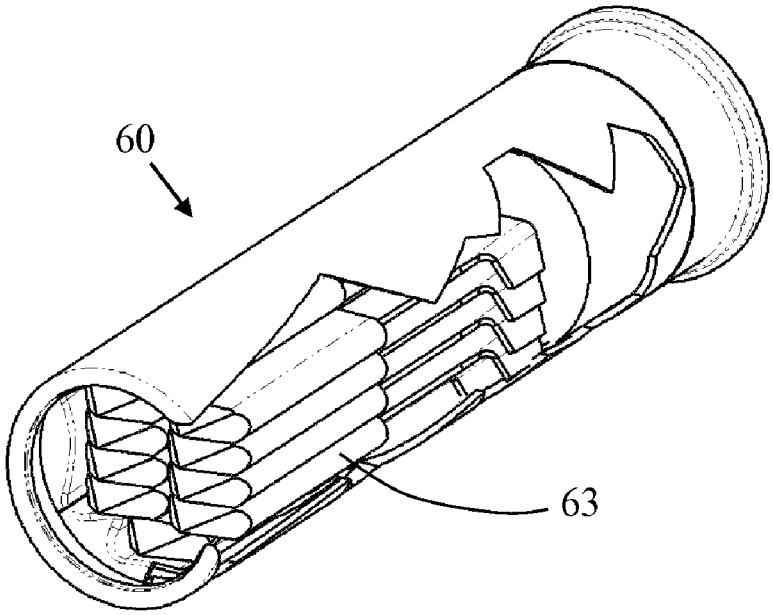
FIG. 12 is an x-ray, perspective view of stacked flechettes according to the present invention within a shotgun shell.

In FIG. 12, a shotgun shell 60 according to the present invention has a stacked configuration of flechettes 63 arranged within the shell. As an alternative to the arrangement of FIG. 12, the flechettes of the present invention could be arranged in a radial orientation so as to be radially stacked around wadding centered within the shotgun shell.

The pragmatic features of the present invention include the fact that when the pucks 40 of flechettes are stacked within a warhead such stacking can be done without the increased cost and complexity and without the longitudinal interleaving of flechettes which occurs in the prior art. Further, the flechettes of the present invention remove the need to turn the flechettes to a particular clocking angle (to improve packing density) as is done in the prior art.

The rectangular cross section of the flechettes of the present invention ensures the flechettes have consistent clocking orientations and that the radial angle of the fins 15A, 15B is oriented at an angle that allows adjacent fins to nest without interference.

The transition from dispense to stable flight is a critical event in the flight of a flechette. When a shotgun shell containing the flechettes according to the present invention is fired or when the flechettes of the present invention are dispensed from a warhead, the flechettes are ejected with high translational velocity, moderate roll rate and moderate to high transverse angular pitch and yaw rates and attitudes into the air.

The location of the center of gravity of the flechette 8 of the present invention when combined with the relatively large tailfin region and its angled S-shaped oriented, rotation-inducing fins 15A, 15B ensure optimal performance. Upon dispense, the flechettes of the present invention quickly weathervane into a nose-first flight orientation even when the fins are aerodynamically stalled due to high angles of attack.

As the flechettes of the present invention assume a nose-first orientation they begin to spin around the longitudinal axis as demonstrated by arrow 18 in FIG. 3. This spinning is accomplished by the offset separation and small incidence angle θ (FIG. 2) of the fins 15A, 15B. The spinning serves the purpose of further enhancing the aerodynamic stability of the flechettes and mitigating the negative effects of high volume production tolerances and misalignments on their flight path.

As a result of the improved aerodynamic properties of the flechette of the present invention, the dispensed flechettes are able to arrive at a target area with greater accuracy and at higher and more consistent velocity. Thus, the size and number of gaps in the dispersion pattern of the flechettes is reduced and target effects are improved.

The flechette of the present invention combines simple and inexpensive manufacturing techniques with improvements in flight performance and packaging. The result is that manufacturing costs of the present invention are competitive with prior art designs; however, the effectiveness of the flechettes is much improved compared to the prior art.

Since the flechettes of the present invention are designed to be self-correcting and self-orienting, an acceptable packing density can be achieved in a warhead or shotgun shell without undue effort and expense.

After the flechettes of the present invention are released from their packaging, their forward placed center of gravity and fin dimensions and orientations ensure that the flechettes are quickly directed toward their intended flight path.

For flechettes which are dispensed from a shotgun shell, the velocity improvements translate into increased range while increasing accuracy.

The flechettes of the present invention allow for rectangular stacking with virtually any number of desired rows or columns of flechettes and allow for radial stacking with virtually any number of radial rows.

What is claimed is:

1. A flechette, comprising:

a forward section containing a center of gravity of said flechette;

a quill connected to said forward section;

a pair of fins integrally connected to said quill, said pair of fins each having a longitudinal angle and a radial angle such that when said pair of fins are viewed from the aft of said flechette, said pair of fins demonstrate an S-shaped orientation, said pair of fins providing stackability and aerodynamic stability to said flechette, and wherein said forward section being rectangular in shape and having a relatively flat top surface and a relatively flat bottom surface.

2. The flechette according to claim 1, wherein:

said flechette can be stacked as part of a formation of rows and columns of like-shaped flechettes.

3. The flechette according to claim 1, wherein:

said flechette can be stacked as a part of a formation of like-shaped flechettes arranged in a radial manner.

4. The flechette according to claim 3, wherein:

said radial manner is a substantially circular arrangement of flechettes.

5. A formation of aerodynamic flechettes, comprising:

a plurality of flechettes arranged and stacked in columns and rows with each flechette of said plurality of flechettes having a nose which is directed in the same forward direction, and wherein:

each flechette of said plurality of flechettes has a forward body, said forward body having a flat top surface and a flat bottom surface, said forward body connecting to a fin section; and wherein:

said fin section of said each flechette of said plurality of flechettes has a pair of fins, said pair of fins each having a longitudinal angle and a radial angle such that when said pair of fins are viewed from the aft of said flechette, said pair of fins demonstrate an S-shaped orientation.

6. A formation of aerodynamic flechettes according to claim 5, wherein:

said nose of each flechette of said plurality of said flechettes is located on said forward body of said each flechette.

7. A formation of aerodynamic flechettes, comprising:

a plurality of flechettes stacked in a radial manner with each flechette of said plurality of flechettes having a nose which is directed in the same forward direction, and wherein:

each flechette of said plurality of flechettes has a forward body having a flat top surface and a flat bottom surface, said forward body connecting to a fin section; and wherein:

said fin section of each flechette of said plurality of flechettes has a pair of fins, said pair of fins each having a longitudinal angle and a radial angle such that when said pair of fins are viewed from the aft of said flechette, said pair of fins demonstrate an S-shaped orientation.

8. A formation according to claim 7, wherein:

said plurality of flechettes are stacked and arranged in a circular manner.

9. A formation of aerodynamic flechettes according to claim 8, wherein:

said nose of each flechette of said plurality of said flechettes is located on said forward body of said each flechette.

* * * * *